US009725838B1

(12) United States Patent
Ribeiro

(10) Patent No.: US 9,725,838 B1
(45) Date of Patent: Aug. 8, 2017

(54) TRANSPORTABLE AND ERGONOMIC WASHER/DRYER COMBINATION WITHIN A SUITCASE HOUSING

(71) Applicant: Socram Services, Inc., Pompano Beach, FL (US)

(72) Inventor: Marcos Ribeiro, Pompano Beach, FL (US)

(73) Assignee: Socram Services, Inc., Pompano Beach, FL (US)

( * ) Notice: Subject to any disclaimer, the term of this patent is extended or adjusted under 35 U.S.C. 154(b) by 0 days.

(21) Appl. No.: 15/285,173

(22) Filed: Oct. 4, 2016

(51) Int. Cl.

| | |
|---|---|
| ***D06F 25/00*** | (2006.01) |
| ***D06F 23/04*** | (2006.01) |
| ***D06F 33/02*** | (2006.01) |
| ***D06F 58/28*** | (2006.01) |
| ***D06F 37/02*** | (2006.01) |
| ***D06F 58/04*** | (2006.01) |
| ***D06F 37/26*** | (2006.01) |
| ***D06F 35/00*** | (2006.01) |
| ***D06F 23/00*** | (2006.01) |

(52) U.S. Cl.
CPC ..... *D06F 25/00* (2013.01); *D06F 23/00* (2013.01); *D06F 23/04* (2013.01); *D06F 33/02* (2013.01); *D06F 35/00* (2013.01); *D06F 37/02* (2013.01); *D06F 37/26* (2013.01); *D06F 58/04* (2013.01); *D06F 58/28* (2013.01)

(58) Field of Classification Search
CPC ..... D06F 23/00; D06F 23/04; D06F 25/00
See application file for complete search history.

(56) References Cited

U.S. PATENT DOCUMENTS

| | | | | |
|---|---|---|---|---|
| 2,746,279 | A * | 5/1956 | Rodriquez Torrent | D06F 35/00 68/20 |
| 2,793,444 | A * | 5/1957 | Turner | D06F 58/14 34/128 |
| 2,903,873 | A * | 9/1959 | Brogdon | D06F 35/00 206/320 |
| 3,357,109 | A * | 12/1967 | Harvey | A45D 20/08 34/607 |
| 5,592,750 | A * | 1/1997 | Eichten | D06F 59/02 223/70 |
| 6,780,101 | B2 * | 8/2004 | Buhler | D06F 58/203 34/390 |
| 2003/0221463 | A1 * | 12/2003 | Chen | D06F 23/04 68/13 R |

(Continued)

*Primary Examiner* — Joseph L Perrin
(74) *Attorney, Agent, or Firm* — Christina Sanchelima; Jesus Sanchelima

(57) ABSTRACT

The present invention provides a portable washing and drying device in a form of a suitcase that is transportable and ergonomic to handle. The device includes a housing transformable into an open or closed state, and including a washing and drying assembly which is configured to wash and dry laundry items. The device further includes modular connections for supplying and removing water, and providing electric power to the assembly which may be removed after use, making the device compact. The device may additionally include suction cups to firmly attach itself with any surface and spring loaded rods for absorbing any shocks from washing/drying operations. The device may also include means like handles and wheels for lending the device to be portable and easily transportable.

17 Claims, 5 Drawing Sheets

(56) References Cited

U.S. PATENT DOCUMENTS

| | | | | |
|---|---|---|---|---|
| 2004/0093758 | A1* | 5/2004 | Miller | D06F 58/14 34/201 |
| 2011/0162442 | A1* | 7/2011 | Ronlan | D06F 37/22 73/66 |

* cited by examiner

TRANSPORTABLE AND ERGONOMIC WASHER/DRYER COMBINATION WITHIN A SUITCASE HOUSING

BACKGROUND OF THE INVENTION

1. Field of the Invention

The present disclosure generally relates to a portable washing and drying device; and more particularly to a portable washing and drying device in a form of a suitcase that is transportable and ergonomic to handle.

2. Description of the Related Art

The conventional washing machine and dryer is a relatively large appliance with a rotating drum driven by an electric motor. The rotating drum provides a tumbling action for washing as well as for drying the clothes. Sometimes, this device also includes an electrical heat source which produces hot air that passes over the clothes as the drum rotates. Such conventional appliance is usually permanently installed in the building and generally requires a large amount of electricity to operate. These conventional appliances usually serve the purpose when large loads of clothing items are required to be washed and/or dried, as in typical households.

Many travellers, either for business or family vacations, wish to wash and dry their clothes while they are away from their homes, where they do not have access to such washing appliances. Generally, in such cases, the amount of load is relatively small, that is, there are only limited number of garments that are needed to be washed and/or dried. One option is to wash clothes by hand which is very cumbersome and messy. Some places do offer laundry services but these are usually very expensive. These travellers would appreciate some portable and transportable device which could be used for washing and drying their clothes while they are away from their homes. Such device would also be appreciated by mobile homes owners or the like, which could not have dedicated laundry space to install large conventional washing and laundry appliances.

Applicant believes that a related reference corresponds to U.S. Patent Application No. 20120085133 (hereinafter referred to as '133 patent application), issued to Fran Z. Slutsky and Matthew Cataudella, which discloses a portable washing appliance for washing small quantities of clothing. A container open at the top has a first compartment for receiving an item of clothing for washing. The container includes a perforated basket which is motor or manually driven to effect a washing operation as well as pre-soaked and rinse operations. Water may be discharged from a first compartment in the container into at least one second compartment, located either below or adjacent thereto, which contains a removable waste receptacle. The waste receptacle collects wash water, rinse water and water extracted during a spin dry operations which may be discarded through a kitchen or bathroom sink drain.

The washing appliance of the '133 patent application although is purported as portable, but it may only be useful to the extent of moving around in the household because of its relatively large size. Further, the washing appliance of the '133 patent application may seem well-suited for use as a countertop type of appliance and may not be particularly suitable for carrying around, such as for travel purposes.

Other documents describing the closest subject matter provide for a number of more or less complicated features that fail to solve the problem in an efficient and economical way. None of these patents suggest the novel features of the present invention.

SUMMARY OF THE INVENTION

An objective of the present invention is to provide a washing and drying device which is capable of washing as well as drying laundry items.

Another objective of the present invention is to provide a washing and drying device which is portable, yet durable and reliable and can be easily manufactured and marketed.

Yet another objective of the present invention is to provide a washing and drying device which is collapsible to the size of a standard suitcase for transportability in an efficient manner and can additionally be used to transport pieces of clothing during travel.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Figure 1:
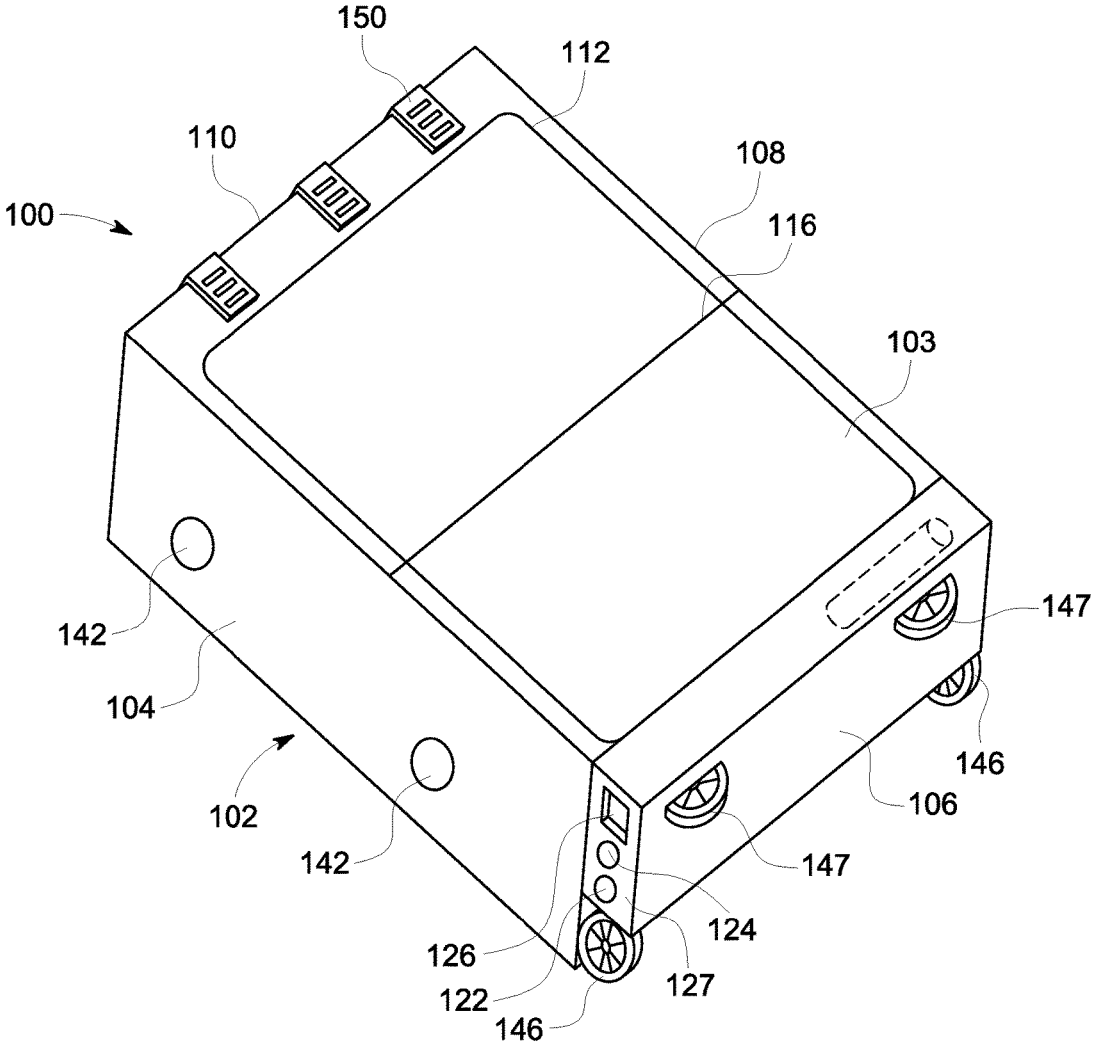
FIG. 1 illustrates a perspective view of a washing and drying device in a closed state, in accordance with an embodiment of the present disclosure.

FIG. 1 illustrates a portable washing and drying device (referenced by the numeral 100 and hereinafter simply referred to as device 100), in accordance with an embodiment of the present invention. The device 100 includes a housing 102 which encompasses all the systems and components of the device 100. In accordance with one embodiment of the present invention, the housing 102 may, generally, be in the shape of a suitcase. The housing 102 may be made of suitable high strength materials to withstand forces and stresses imparted from various angles and positions during the washing/drying operation of the device 100 and as the device 100 travels through different conditions. The selected material may further be light-weight so that the device 100 may still being easily transportable. In one example, the housing 102 may be made of carbon fiber materials.

The housing 102 may be sized and shaped to be easily transportable and compact, while still be able to accommodate all the systems and components of the device 100, along with articles of clothing. Referring to the drawings in general, it may be seen that the housing 102 may have substantially cuboidal shape with rectangular cross-section along a top face 103. In other examples, the housing 102, may have other possible sectional shapes such as parallelogram, trapezoidal, or any other polygonal shape, without any limitations. The housing 102 may have a first side 104, a second side 106 orthogonal to the first side 104, and a third side 108 and a fourth side 110 opposite to the first side 104 and the second side 106, respectively. In some examples, all of the sides 104, 106, 108, 110 may form circular edges when adjacent sides meet each other to complete the housing 102. In one example, the first side 104 and the third side 108 may be approximately 3 feet in length, and the second side 106 and the fourth side 110 may be approximately 2 feet in length. Further, the sides 104, 106, 108, 110 may be approximately 1 foot in height. It may be contemplated that the given dimensions are only exemplary, and the housing 102 may have different dimensions as per requirement and design constraints.

Figure 2:
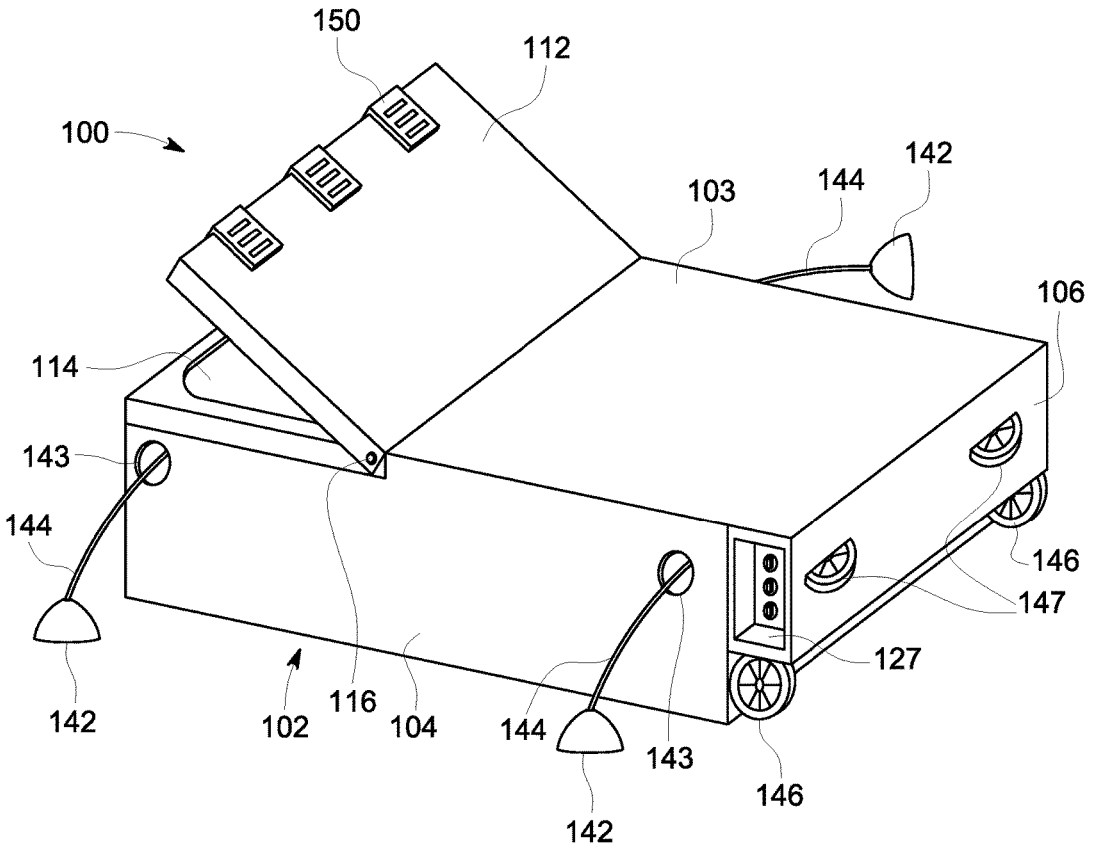
FIG. 2 illustrates a side perspective view of the device of FIG. 1, in a semi-open state.
Figure 3:
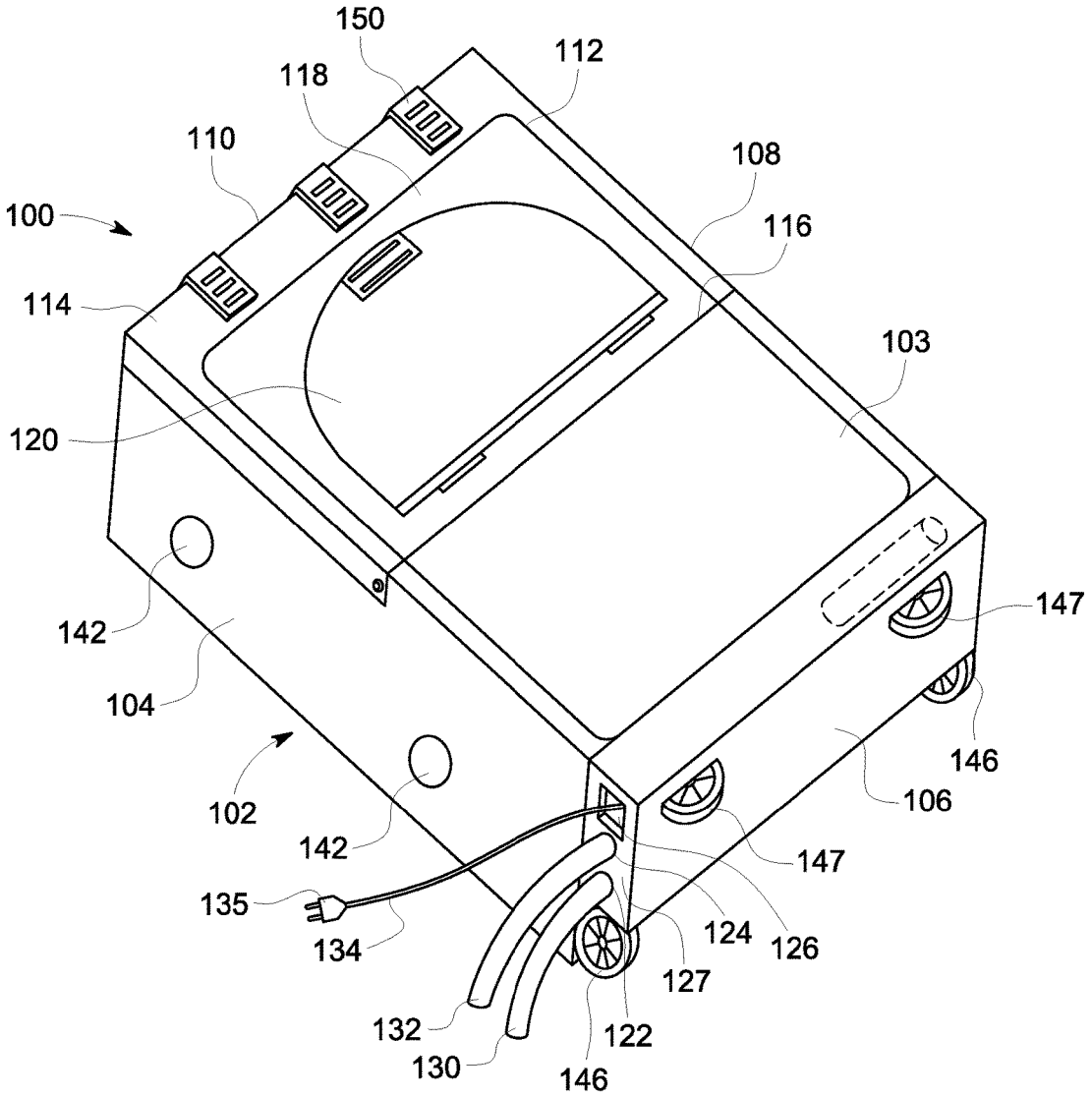
FIG. 3 illustrates a side perspective view of the device of FIG. 1, in an open state.

The housing 102 may include a cover 112 adapted to be rotatable, so as to place the device 100 between a closed state and an open state. In FIG. 1, the device 100 is shown in the closed state. Further, in FIGS. 2-3, the cover 112 is shown to be rotating to place the device 100 from the closed state to the open state. As more clearly illustrated in FIG. 3, the housing 102 may include a hollow chamber 114 (exposed in the open state of the device 100) formed therein. In FIG. 3, only one-half of the chamber 114 is exposed, and it may be understood that the other half would lie beneath the top face 103 of the housing 102. In one example, the cover 112 is coupled to the housing 102 by means of a hinge joint 116, so as to be rotatable with respect to the housing 102. It may be seen that the hinge joint 116 may be disposed along an inner edge of a top face 103 of the housing 102, such that the hinge joint 116 may be located substantially along a center line of the top face 103. It may be seen from FIG. 3, when the device 100 is placed in the open state with the cover 112 being fully rotated, the cover 112 may rest on the top face 103 of the housing 102. In an alternate example (not shown), the cover 112 may be removably attached to the housing 102. In one example, the housing 102 may be provided with some markings (not shown) such that the user may be able to identify the top face 103 and be able to correctly place the device 100 on the ground.

The device 100 of the present invention may generally include a washing and drying assembly 118 (as shown in FIG. 3) for achieving the required purpose of washing and drying of clothing items and garments. Hereinafter the terms "washing and drying assembly 118" and "assembly 118" have been interchangeably used without any limitations. The washing and drying assembly 118 of the device 100 may be supported within the chamber 114. It may be contemplated that the assembly 118 could be made accessible by rotating or removing the cover 112 and putting the device 100 in the open state. In open state of the housing 102, as illustrated in FIG. 3, the washing and drying assembly 118 may be accessed, for example, for loading and unloading of the clothing items to be laundered. Further, in some examples, the assembly 118 may include a separate top cover 120 to limit access to the assembly 118 during its operation. The top cover 120 may come with a handle (not shown) so that it may be pivoted or lifted off the assembly 118 in order to access the washing volume underneath, for example, for loading of clothing items therein.

In the device 100 of the present invention, the washing and drying assembly 118 may be any assembly capable of performing washing and drying operations. In one example, the assembly 118 may have a conventional washing machine set-up, including an outer tub with an inner perforated tub placed therein, and wherein the inner perforated tub is configured to rotate inside the outer tub as per a spin cycle while the laundry, water and detergent is retained therein; such that when the inner perforated tub rotates, the laundry inside therein is tumbled and thereby cleaned; and further after the cleaning step is completed, the inner perforated tub is rotated without water so as to dry the cleaned laundry in the assembly 118. In other examples, the assembly 118 may use an ion exchange method or the like for washing and drying operations. It may be contemplated that the assembly 118 may employ any washing and drying methods known in the art without any limitations.

Figure 4:
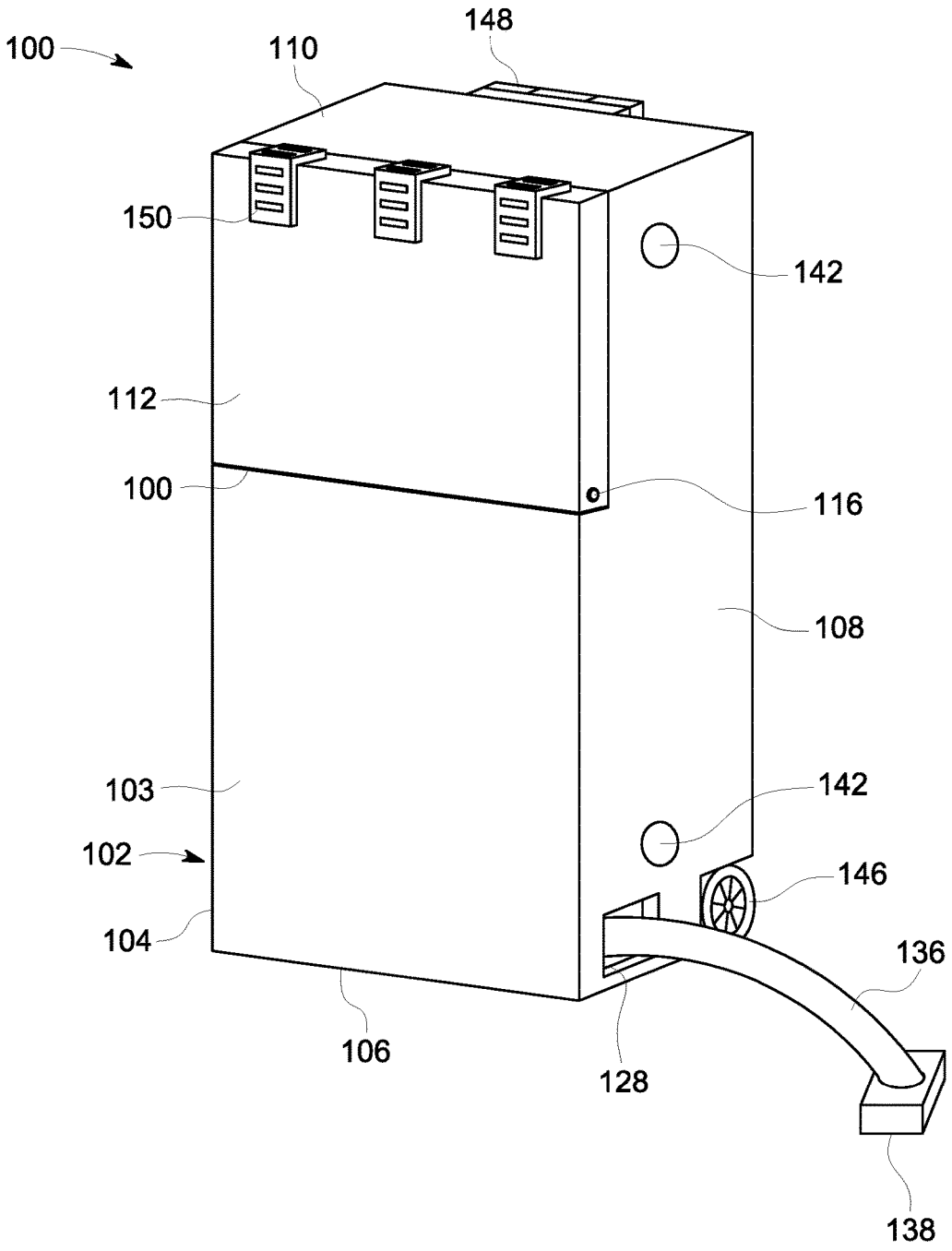
FIG. 4 illustrates a top perspective view of the device of FIG. 1, in the closed state.

It may be understood that, in general, the assembly 118 may require access to water and electricity for its operations, and further some sort of vent mechanism for drying the clothing items therein. The device 100 of the present invention may include arrangements such that the resources like water and electricity may be supplied to the assembly 118. As illustrated in FIGS. 1-2, the device 100 includes a water connection 122, a drain connection 124 and an electric connection 126. In one example, the water connection 122, the drain connection 124 and the electric connection 126 are provided at the first side 104 of the housing 102. In particular, the housing 102 may include a panel 127 formed at the first side 104 in which these connections 122, 124, 126 are provided. Further, as illustrated in FIG. 4, the device 100 may include a vent connection 128 provided on the third side 108 of the housing 102. It may be seen that the connections 122, 124, 126, 128 may be, generally, located proximal to a bottom end of the corresponding sides of the housing 102, when the device 100 is placed in upright position, as better illustrated in FIGS. 4 and 5. It may be contemplated that these connections 122, 124, 126, 128 may extend via their corresponding sides in to the housing 102 and are disposed in connection with the assembly 118, in the device 100.

In one embodiment, as illustrated in FIG. 3, the water connection 122 may include a water supply pipe 130 to receive water from a source (not shown), such as a faucet, and pass it to the assembly 118. Similar to the water connection 122, the drain connection 124 may include a drain pipe 132 to take waste water out of the assembly 118 after washing of the laundry and drain that waste water out of the device 100, for example, in a sink. It may be understood that the water connection 122 and the drain connection 124 may be disposed in fluid communication with inside of the assembly 118. Further, the electric connection 126 may include a flexible wire 134 connected to the panel 127 at one end and further provide a plug 135 at the other end, to be connected to a power socket (not shown) in order to provide electric power to the assembly 118. In one example, the assembly 118 may be powered by a 110V, 15 Amps A/C current; however, other standard power supplies may also be utilized by using an adapter or the like, with the plug 135.

Figure 5:
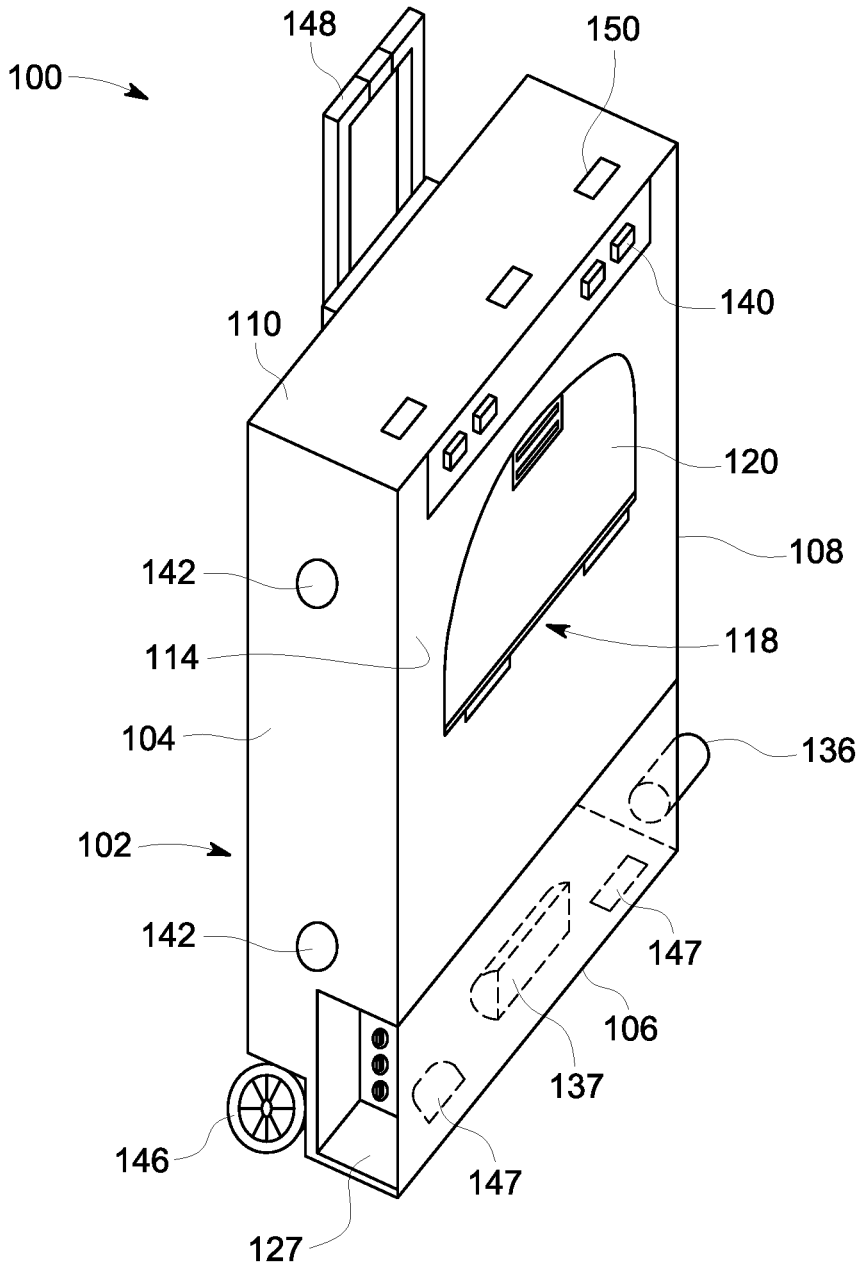
FIG. 5 illustrates a top perspective view of the device of FIG. 1, with a cover and a top face removed.

Further, the vent connection 128 may be provided on the third side 108, in fluid communication with inside of the assembly 118. The vent connection 128 may include a vent hose 136 removably coupled to the housing 102 from one end. It may be contemplated that the vent hose 136 may be connected to the assembly 118 only during its drying operation. The vent connection 128 may include also a blower 137 (as represented in FIG. 5), to provide suction for removal of moisture-laden air from inside of the assembly 118, and thereby drying the clothing items therein. In one example, the vent connection 128 may also include a lint catcher 138 disposed at other end of the vent hose 136. The lint catcher 138 may be in the form of a casing and further include a pull-out canister (not shown) which could be cleaned of the trapped lint regularly.

In one example, the water supply pipe 130 may be flexible so it may be routed as desired to reach the water source. The water supply pipe 130 may be removably mounted to the housing 102, and therefore may only be connected when the water supply is required, as during washing operation of the assembly 118 and thereafter may be removed. Similarly, the drain pipe 132 may also be flexible and removably connected to the housing 102, and may be connected when drainage of waste water is required. Also, the vent hose 136 may be removed from the device 100, when the assembly 118 is not performing drying operation or not in use. In one example, the water supply pipe 130, the drain pipe 132 and the vent hose 136 may be approximately 3 feet in length and 3 inches in diameter. In one example, the chamber 114 or the cover 112 may include cut-outs or the like (not shown) formed therein to securely accommodate the disconnected water supply pipe 130, the drain pipe 132 and the vent hose 136 within the housing 102, when not in use. Further, the flexible wire 134 may be rolled back and put inside the housing 102, for portability and transportability of the device 100. Furthermore, the panel 127 may be covered with a cap (not shown) to close the water connection 122, the drain connection 124 and the electric connection 126, and same with the vent connection 128, in order to avoid leakage of any waste water therefrom.

It may be contemplated by a person skilled in the art that the assembly 118 may include motor or the like for agitating the water therein for washing of the clothing items. The device 100 may include controls 140 for controlling its various operations, such as, but not limited to, defining spin cycle and accordingly adjusting the power supply to the motor, controlling the pumping of the water supply in and out of the assembly 118, etc. In one example, the controls 140 may be manual controls located on the assembly 118 (as illustrated in FIG. 5). The controls 140 may be in the form of buttons, dials or the like. In other example, the controls 140 may be automatic, i.e. the assembly 118 may be able to perform most of the functions like timing the spin cycle, pumping water for washing, draining water after washing, etc. without much human intervention. Such controls are well known in the art and thus have not been described in detail herein for the brevity of the disclosure.

Further, in one embodiment of the present invention, the device 100 may be provided with suction cups 142 in order to firmly place the device 100 on the ground. This may particularly be required during washing and/or drying operations of the device 100, as the device 100, otherwise, may vibrate/move during such operations. In one example, as illustrated in FIGS. 1 and 2, the suction cups 142 may be provided at the first side 104 and the third side 108 of the housing 102. In some examples, as many as four suction cups 142 may be provided, two each at the two sides 104, 108; however, the number may vary based on the requirement. Specifically, the suction cups 142 may be supported in holes 143 provided in the sides 104, 108. Further, the suction cups 142 may be connected to the housing via a line 144. When required, any of the suction cups 142 may be pulled out of the holes 143 and its line 144 may be extended to the ground for temporarily attaching that suction cup 142 therewith. Further, in one example, the line 144 may be resilient so it absorbs shocks during operation of the assembly 118, and thereby avoid/minimize any possible damage to the assembly in particular, and the device 100 in general. In some examples, the lint catcher 138 may also include a suction cup 142 at its base, in order to firmly attach itself with the ground, and thereby avoid any possible movement of the vent hose 136 from the pressure of air therein, during the drying operation. In some other examples, the water supply pipe 130 and the drain pipe 132 may also include suction cups to firmly attach those with the ground or any other surface during the washing operation of the device 100.

In one embodiment, the device 100 may also include wheels 146 provided at the second side 106 of the housing 102. Specifically, the device 100 may include at least two laterally separated wheels 146 disposed proximal to the corners formed, at the junction of the first side 104 and the second side 106, and the junction of the second side 106 and the third side 108, with a bottom face of the housing 102. Further, as more clearly illustrated in FIG. 1, the device 100 may also include two castor wheels 147 laterally separated and disposed at the second side 106 of the housing 102. The device 100 of the present invention may also include a retractable handle 148 as conventionally provided with suitcases. Furthermore, the device 100 may include a locking arrangement (represented by the numeral 150), such as a clasp or the like, arranged between the fourth side 110 and the cover 112. The locking arrangement 150 may be configured to lock the cover 112 with the housing 102 for putting the device 100 in the closed state, for example, when the device 100 needs to be moved or transported.

It may be understood that the device 100, or in particular the assembly 118, may be operable in both the open and closed state of the housing 102. In one example, the device may be placed in laid back position (as shown in FIGS. 1-3) during the washing operation and in upright position (as shown in FIGS. 4-5) during the drying operation. It may be contemplated that during washing or drying operation, the device 100 may generally be placed near basin, shower or sink, and crimped on the surface thereon by means of the suction cups 142. When not in operation, the device 100 may additionally be used as a luggage bag for carrying the clothes, garments, etc.

The device 100 of the present invention is light, compact and is as portable as a piece of luggage. Further, the set-up procedure of the device 100 is simple and no complex assembly is required beyond connecting the water supply pipe 130 to a water faucet, positioning the drain pipe 132 near a sink, plugging the flexible wire 134 in a power socket, and further connecting the vent hose 136 during drying operation; all of which could be completed within a matter of minutes. Further, the device 100 is designed to take little storage space and can be put in a small closet or on a shelf when not in use. The loading capacity of the device 100 for a single spin cycle may be comparatively smaller than a standard household washing machine, but the device 100 helps with reducing the size and weight from that of the standard washing machine, while also increasing cleaning efficiency, and reducing environmental pollution and impact to a greater extent than heretofore possible.

The present invention can be used by service technicians, doctors, families with infants and small children, pilots, truck drivers, athletes, salespersons, tourists, elderly people, and all other people who would like to clean their dirty laundry within the same suitcase.

The foregoing description conveys the best understanding of the objectives and advantages of the present invention.

Different embodiments may be made of the inventive concept of this invention. It is to be understood that all matter disclosed herein is to be interpreted merely as illustrative, and not in a limiting sense.

What is claimed is:

1. A device to clean clothes comprising:

a suitcase having a housing defined by a unitary body that includes a cover for opening and closing said unitary body and said unitary body further including a top side, first side, second side, and bottom side, said housing having a vent, a handle extending from said top side, a wheel assembly located on said bottom side, said wheel assembly including wheel members spaced apart from each other a predetermined distance to allow said housing to be rolled by a user using said handle, a washing and drying assembly having a washing and drying phase, said washing and drying assembly mounted underneath said cover and accessed when the cover is opened, said washing and drying assembly having a water connection, a drain connection and an electric connection, wherein said washing and drying assembly further includes a motor and an outer tub with an inner perforated tub therein configured to rotate within said outer tub as per a spin cycle when laundry, wherein water and detergent is retained therein, and said inner perforated tub spins without water to dry the clothes once the washing phase is completed.

2. The device of claim 1 wherein said housing is made of plastic.

3. The device of claim 1 wherein said housing is made of carbon fiber.

4. The device of claim 1 wherein said housing has a cuboidal shape.

5. The device of claim 1 wherein said housing has a parallelogram, trapezoidal, or any other polygonal shape.

6. The device of claim 1 wherein said unitary body includes a fixed portion and a hingedly mounted portion, said hingedly mounted portion is positioned in an open or closed state, a hollow chamber is located underneath said hingedly mounted portion.

7. The device of claim 6 wherein said hingedly mounted portion has a hinge joint along the centerline of said top side.

8. The device in claim 1 wherein said vent is either on the first or second side.

9. The device in claim 1 wherein said water connection includes a water supply pipe, said drain connection includes a drain pipe to take waste water out of the assembly, said electric connection includes a flexible wire that has a plug on one end to be connected to a power socket.

10. The device of claim 9 wherein said flexible wire can be retracted back into said housing.

11. The device in claim 1 wherein said vent connection includes a blower to remove moisture-laden air.

12. The device in claim 1 wherein said vent connection includes a lint catcher.

13. The device in claim 1 wherein said drain connection and water connection are removable, said cover including cut-outs where said drain connection and water connection can be stored.

14. The device in claim 1 including controls for controlling and timing the spin cycle, power supply to the motor, and the pumping of the water supply in and out of the assembly, and draining water after washing.

15. The device of claim 1 wherein a plurality of suction cups are mounted to the housing to keep in firmly on a surface where the device is placed.

16. The device of claim 1 wherein at least one suction cup is mounted to the drain connection, the water connection, or the electrical connection to keep those connections and their components secured.

17. The device of claim 1 wherein said handle is retractable.

* * * * *